US005746356A

United States Patent [19]

Kieras

[11] Patent Number: 5,746,356

[45] Date of Patent: May 5, 1998

[54] ROTATABLE SPOUT DISPENSING TUBE

[75] Inventor: Ronald E. Kieras, Woodstock, Ill.

[73] Assignee: Courtaulds Packaging Inc., Woodstock, Ill.

[21] Appl. No.: 758,902

[22] Filed: Dec. 2, 1996

[51] Int. Cl.[6] ..... B65D 35/48

[52] U.S. Cl. ..... 222/212; 222/531; 222/553

[58] Field of Search ..... 222/92, 107, 212, 222/215, 531, 532, 536, 548, 553

[56] References Cited

U.S. PATENT DOCUMENTS

| | | | |
|---|---|---|---|
| 985,322 | 2/1911 | Beals . | |
| 1,739,303 | 12/1929 | Hawkins . | |
| 1,974,348 | 9/1934 | Strehs | 221/60 |
| 2,619,266 | 11/1952 | McDonald | 222/548 |
| 2,924,393 | 2/1960 | Robert | 222/553 X |
| 2,966,286 | 12/1960 | Moran | 222/553 |
| 3,118,578 | 1/1964 | Collins | 222/212 |
| 3,255,937 | 6/1966 | Jarrett | 222/480 |
| 3,718,239 | 2/1973 | Cochran | 222/548 |
| 4,084,728 | 4/1978 | Stahl et al. | 222/153 |
| 4,141,475 | 2/1979 | Nilson | 222/494 |
| 4,308,979 | 1/1982 | Otterson | 222/516 |
| 4,739,906 | 4/1988 | LoTurco | 222/153 |
| 4,964,548 | 10/1990 | Kenyon, Jr. | 222/521 |
| 5,275,338 | 1/1994 | Tobler | 222/212 X |

FOREIGN PATENT DOCUMENTS

| | | | |
|---|---|---|---|
| 0087562 | 9/1983 | European Pat. Off. | 222/212 |
| 2041739 | 9/1980 | United Kingdom | 222/553 |

*Primary Examiner*—Kenneth Bomberg

*Attorney, Agent, or Firm*—Armstrong, westerman, Hattori, McLeland & Naughton

[57] ABSTRACT

A rotatable spout dispensing tube has a tubular member and associated closure cap with a nozzle. The tubular member neck portion has a planar wall with a central discharge aperture and an upwardly extending arcuate projection, the projection having a gap therethrough. The closure cap has a top wall with a spout thereon, the spout having a passageway which communicates with a central bore, the bore surrounded by a circular rim that seats in the central discharge aperture of the tubular member. An arcuate channel is also provided in the closure cap top wall in which the arcuate projection on the tubular member is slidably fitted. Contents of the tubular member are dispensed by aligning the passageway of the spout with the gap in the arcuate projection and application of pressure on the side wall of the tubular member.

6 Claims, 3 Drawing Sheets

ROTATABLE SPOUT DISPENSING TUBE

FIELD OF THE INVENTION

The present invention relates to a rotatable spout dispensing tube comprising a collapsible tube that has a closure cap with a nozzle, with the ability to dispense contents of the tube through the nozzle by rotation of the cap from a sealing position to a dispensing position and applying pressure to the wall of the tube.

BACKGROUND OF THE INVENTION

Collapsible thermoplastic tubes are used for the storage and dispensing of numerous everyday consumer products such as toothpaste, shampoo, cosmetics, beauty-aids, foodstuffs and the like. Usually such collapsible tubes are sealed at one end and have a head at the other end with an opening therethrough for dispensing the contents of the tube. A separate removable cap is usually provided to close the tube opening when the tube is not in use so as to protect the contents of the tube from the environment. Oxygen, in air, for example can oxidize and render unusable the tube contents or dry air can cause the tube contents to dry out and become unusable. While such tube caps serve the purpose of protecting the tube contents, problems can arise because of the need to remove the cap from the tube in order to have access to the tube contents. At times, the cap may be difficult for a person with an impaired grip to grasp and remove the cap from the tube. Also, after removal of the cap, a user must find a place to set the cap. Sometimes, dropping or rolling of the cap to an undesirable place will cause problems. The cap may be lost or may be damaged or otherwise adversely treated so as to render it useless. In addition, after squeezing the desired amount of the tube contents from the tube, the user must replace the cap onto the tube and reseal the tube contents by use of the cap.

It is an object of the present invention to provide a rotatable spout tube and closure cap that will enable discharge of the tube contents when desired without need for removal of a closure cap from the tube.

It is another object of the present invention to provide a rotatable spout tube and closure cap that will protect the contents of the tube when the spout is in one position while permitting discharge of the contents of the tube without removal of a closure cap from the tube when the spout is in another position.

It is a further object of the present invention to provide a rotatable spout tube and closure cap which seals the contents of the tube from the environment, while enabling discharge of the contents of the tube without removal of the closure cap through partial rotation of the closure cap on the tube body in one direction and resealing of the tube merely by reverse rotation of the closure cap.

SUMMARY OF THE INVENTION

A rotatable spout dispensing tube has a tubular member and an engaged rotatable closure cap with a spout.

The tubular member has a bottom wall, side wall, and a neck portion at the opposite end from the bottom wall which is engageable with a closure cap. The neck portion of the tubular member is closed by a planar wall which has a central discharge aperture through which tubular member contents can pass. An arcuate, upwardly extending projection is provided on the planar wall, which projection has a gap therethrough. The neck portion of the tubular member also has an engaging device, such as a groove, for rotatably securing a closure cap to the tubular member.

The closure cap is provided having a circular top wall with a downwardly depending annular skirt about the top wall, the skirt having a device, such as a flange, thereon for engagement with the tubular member. The top wall has a spout associated therewith which extends outwardly therefrom. A passageway is formed through the spout leading from the central region of the top wall radially outwardly beyond the annular skirt. In the bottom surface of the top wall of the closure member there is provided a central bore which communicates with the passageway of the spout and a downwardly depending circular rim is formed about the central bore, the circular rim adapted to closely fit within the central discharge aperture of the tubular member. Also provided in the bottom surface of the top wall of the closure cap is an arcuate channel which is spaced from and concentric with the circular rim about the central bore.

The closure cap and tubular member are arranged such that the closure cap can be secured to the tubular member, but is rotatable thereon, with the circular rim of the closure cap seated in the central discharge aperture in the planar wall of the tubular member, and the upwardly extending projection on the neck portion of the tubular member slidably fitted in the arcuate channel formed in the bottom surface of the top wall of the closure cap. With this arrangement, the closure cap may be rotated relative to the tubular member such that in one, or a rest position, the passageway of the closure cap spout is sealed by the upwardly extending projection on the planar wall of the tubular member, while in a rotated second, or dispensing, position the passageway of the spout is aligned with the gap in the upwardly extending projection. In the dispensing position, communication is thus provided between the central discharge aperture of the planar wall of the tubular member, the bore in the top wall of the closure member, the passageway through the spout and the gap through the upwardly extending projection on the planar wall of the tubular member. Pressure on the side wall of the tubular member will thus cause flow of contents of the tubular member through the central discharge aperture, central bore, spout passageway and gap and dispensing of the contents from the rotatable spout dispensing tube.

BRIEF DESCRIPTION OF THE DRAWINGS

The present invention will become more readily apparent from the following description when read in conjunction with the accompanying drawings which illustrate a preferred embodiment thereof, and wherein.

DETAILED DESCRIPTION

Figure 1:
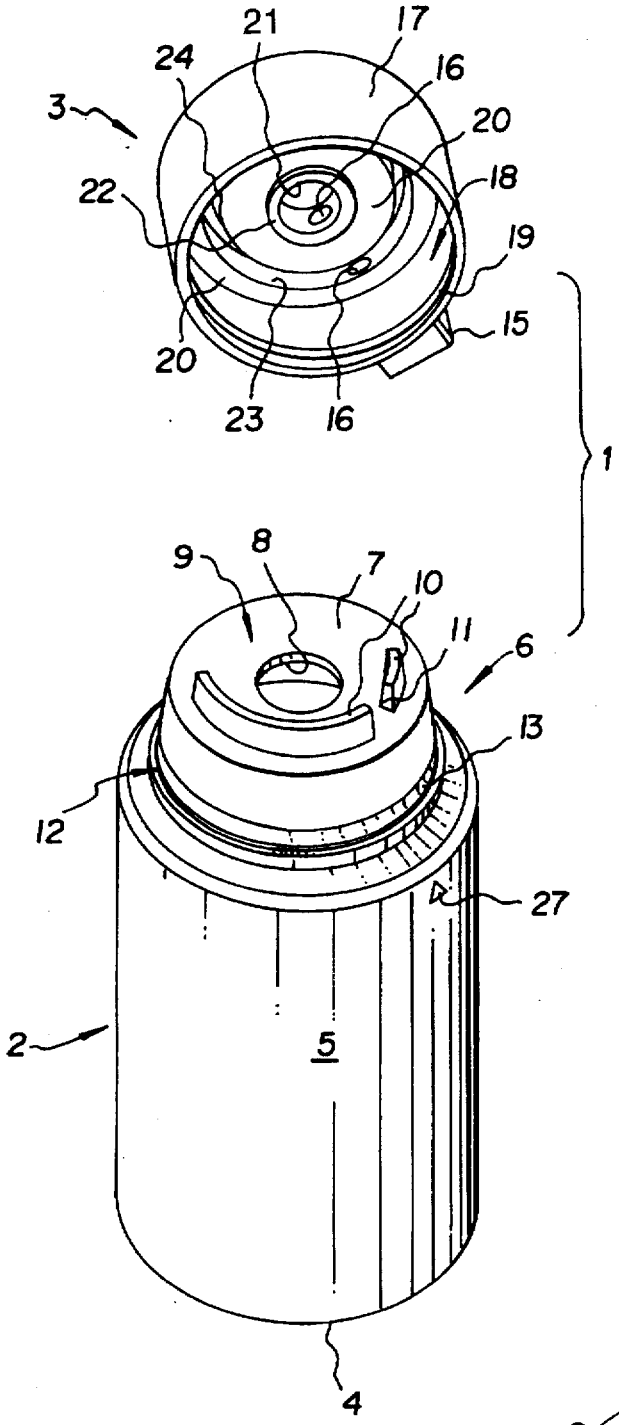
FIG. 1 is an exploded perspective view of the rotatable spout dispensing tube of the present invention showing the closure cap separated from the tubular member.
Figure 2:
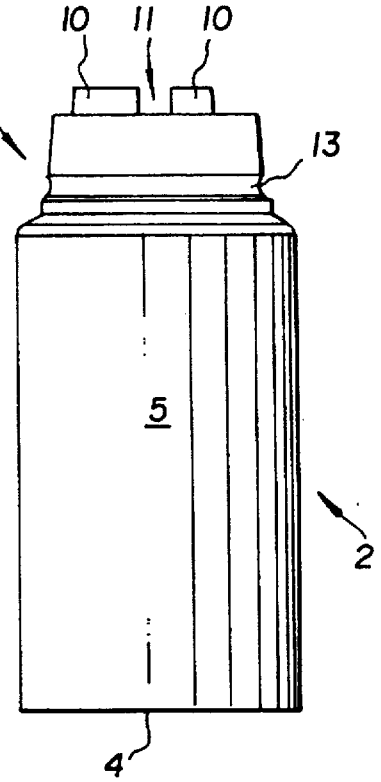
FIG. 2 is a side elevational view of the tubular member illustrated in FIG. 1 showing the gap in the projection on the planar wall.
Figure 3:
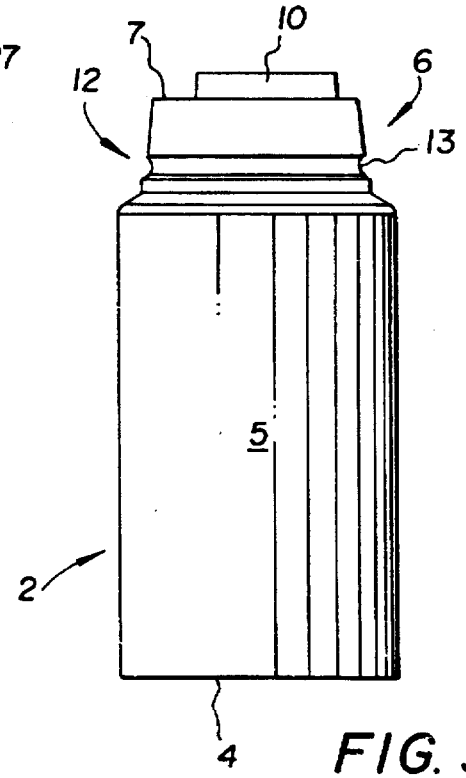
FIG. 3 is a side elevational view similar to FIG. 2 showing the tubular member turned to show the projection away from the gap therein.
Figure 4:
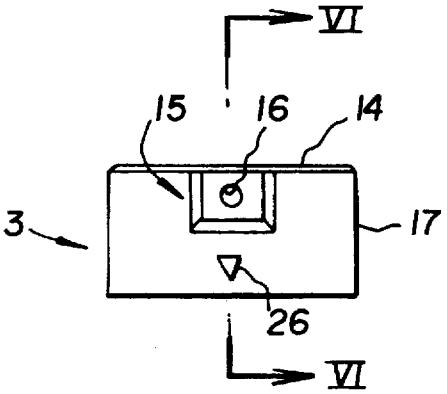
FIG. 4 is a front side elevational view of the closure cap illustrated in FIG. 1 showing the front of the spout and spout passageway.
Figure 5:
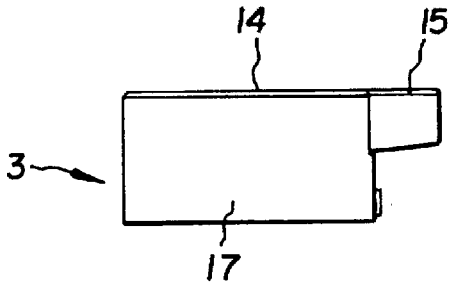
FIG. 5 is a side elevational view of the closure cap of FIG. 1.
Figure 6:
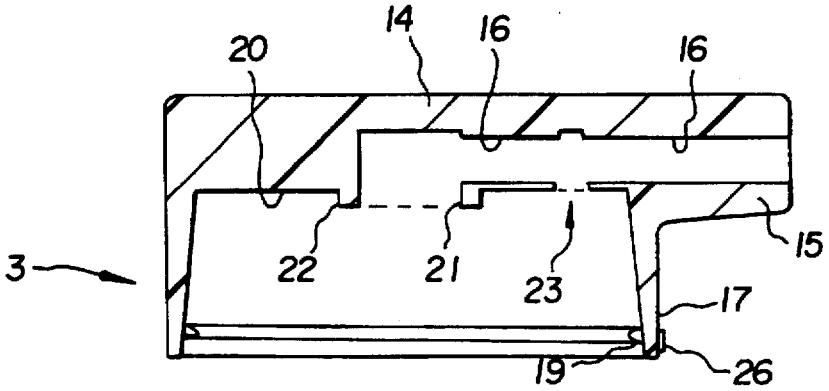
FIG. 6 is a cross-sectional view through the closure cap of FIG. 1 taken along the lines VI—VI of FIG. 4.
Figure 7:
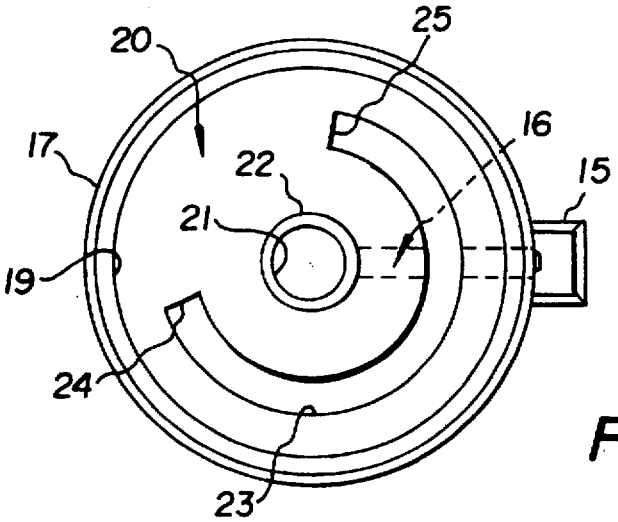
FIG. 7 is a bottom plan view of the closure cap illustrated in FIG. 1.

Referring now to the drawings, a rotatable spout dispensing tube 1 is illustrated having a tubular member 2 and a closure cap 3.

The tubular member 2 has a bottom wall 4, a side wall 5, and a neck portion 6 at the end of the tubular member opposite the bottom wall 4. The neck portion 6 is adapted for engagement therewith of a closure cap 3. The neck portion 6 is closed by a planar wall 7 that has a central discharge aperture 8 therethrough and an upper surface 9. On the upper surface 9 of the planar wall 7 there is provided an arcuate upwardly extending projection 10, the projection 10 having a gap 11 therethrough. In order to engage a closure cap 3 on the neck portion 6 of the tubular member 2, a closure cap engagement means 12, such as an inwardly extending groove 13 in the neck portion 6, is provided. The tubular member 2 is formed from a flexible material, a thermoplastic material such as polyethylene or polypropylene or copolymers thereof, such that pressure on the side wall 5 will cause the contents of the tube to be exuded through the central discharge aperture 8 in the planar wall 7 of the tubular member 2.

The closure cap 3, also formed from a thermoplastic material such as polyethylene or polypropylene or copolymers thereof, has a circular top wall 14, with a spout 15 extending outwardly adjacent to the top wall 14, the spout 15 having a passageway 16, which spout 15 extends radially outwardly from the closure cap 3. The closure cap 3 has a downwardly depending annular skirt 17 extending about the top wall 14, the downwardly depending annular skirt 17 having a tubular member engagement means 18 thereon, such as an inwardly extending flange 19, which engages the closure cap engagement means 12 on the tubular member 2 and is adapted to retain the closure cap 3 on the tubular member 2 while permitting rotation of the closure cap 3.

The top wall 14 of the closure cap 3 has a bottom surface 20, the bottom surface 20 having a central bore 21 which communicates with the passageway 16 of the spout 15, and a downwardly depending circular rim 22 about the central bore 21 that is arranged to fit within the central discharge aperture 8 of the planar wall 7 of the tubular member 2 when the closure cap 3 is engaged with the tubular member 2. Also formed in the bottom surface 20 of the top wall 14 of the closure cap is an outer arcuate channel 23 which is spaced from and concentric with the circular rim 22. Preferably, the arcuate channel 23 extends only partially concentrically about the circular rim 22 and has end faces 24 and 25. The arcuate channel 23 has a depth sufficient such that the passageway 16 of the spout 15 extends through the arcuate channel 23.

Figure 8:
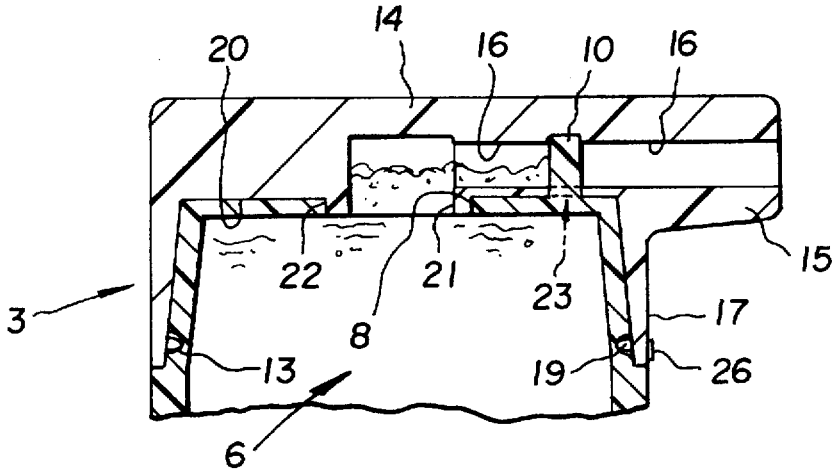
FIG. 8 is a cross-sectional view through the assembled closure cap and tubular member of FIG. 1 with the closure cap in sealing position.
Figure 9:
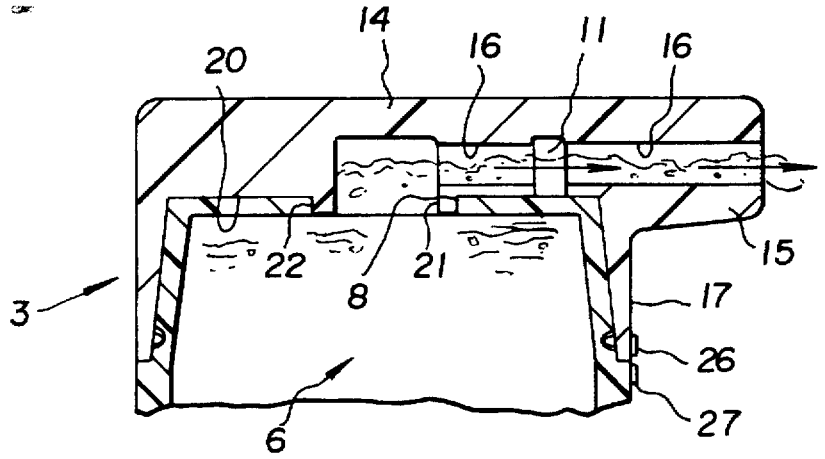
FIG. 9 is a cross-sectional view through the assembled closure cap and tubular member of FIG. 1 with the closure cap in dispensing position.

The rotatable spout dispensing tube of the present invention enables protection of the contents of the tube from the environment when the closure cap is in a first or rest position and dispensing of the contents of the tube through the closure cap when the closure cap is in a second, rotated, or dispensing position without removal of the closure cap from securement with the collapsible tubular member. As illustrated in the drawings, with particular reference to FIG. 8, the tubular member 2 is filled with dispensable contents and the closure cap 3 secured to the tubular member 2. In rest position, the downwardly depending circular rim 22 about the circular bore 21 in the closure cap seats in the central discharge aperture 8 in the planar wall 7 of the tubular member 2, and with the arcuate upwardly extending projection 10 on the tubular member 2 slidably fitted within the arcuate channel 23 in the bottom surface 20 of the top wall 14 of the closure cap 3, with the passageway 16 of the spout 15 sealed by the upwardly extending projection 10 in the arcuate channel 23. In this position, a rest position, the contents of the tubular member are thus sealed from the environment. By rotation of the closure cap 3 on the tubular member, however, to a dispensing position, the contents of the tube may be dispensed without removal of the closure cap 3 from the tubular member 2. As illustrated in the drawings, with particular reference to FIG. 9, rotation of the closure cap 3 on the tubular member 2 can be effected to a position where the passageway 16 of the spout 15 is aligned with the gap 11 in the arcuate upwardly extending projection 10. In this rotated or dispensing position, communication is provided between the central discharge aperture 8 in the planar member 7 of the tubular member 2, the central bore 21 in the bottom surface 20 of the top wall 14 of the closure cap 3, gap 11 of the arcuate upwardly extending projection 10, and the passageway 16 of the spout 15. When in such a dispensing position, application of pressure, such as by squeezing with a user's hand, will then cause flow of contents of the tubular member 2 through the central discharge aperture 8, the central bore 21, the spout passageway 16 and the gap 11 in the upwardly extending projection 10 and discharge of the contents from the rotatable spout dispensing tube 1.

Indicia 26, such as a raised surface, may be provided on the skirt 17 of the closure cap 3 which when aligned with indicia 27, such as a raised surface, on the tubular member 2 will indicate to the user that the closure cap 3 has been positioned in a dispensing position for the rotatable spout dispensing tube.

What is claimed is:

1. A rotatable spout dispensing tube comprising:

a thermoplastic tubular member having a bottom wall, a side wall, and a neck portion at an opposite end from the bottom wall, a planar wall closing said neck portion having an upper surface with a central discharge aperture therethrough, and an arcuate upwardly extending projection thereon, said projection having a gap therethrough said projection extending only partially concentrically about said central discharge aperture, and said neck portion having a closure cap engagement means;

a thermoplastic closure cap having a circular top wall and a spout extending outwardly adjacent to said top wall with the top wall and said spout having a passageway formed therethrough, a downwardly depending annular skirt about said top wall, said annular skirt having a tubular member engagement means thereon engageable with said closure cap engaging means of said tubular member;

the top wall of said closure cap having a bottom surface, a central bore formed in said bottom surface communicating with the passageway of said top wall and spout, a downwardly depending circular rim about said central bore adapted to fit within the central discharge aperture in the neck portion of said tubular member, and an outer arcuate channel in said bottom surface, said channel extending only partially concentrically about said circular rim, spaced from and concentric with said circular rim;

such that when said closure cap is secured on the neck portion of said tubular member, said circular rim seats in the central discharge aperture and said upwardly extending projection on the neck portion of said tubular member slidably fits within the arcuate channel formed in the bottom surface of the top wall of the closure cap, whereby in one position the passageway of said spout is sealed by said projection and in a rotated position said passageway is aligned with the gap of said projection to provide communication between the central discharge aperture of said tubular member, the bore of said top wall, the gap through said projection, and the passageway of said top wall and spout for dispensing of contents of said tubular member by pressure on the side wall of said tubular member.

2. The rotatable spout dispensing tube as defined in claim 1 wherein said closure cap engagement means on said tubular member is an inwardly extending groove.

3. The rotatable spout dispensing tube as defined in claim 2 wherein said tubular member engagement means is an inwardly directed flange.

4. The rotatable spout dispensing tube as defined in claim 1 wherein said tubular member is formed from a thermoplastic material selected from the group consisting essentially of polyethylene, polypropylene and copolymers thereof.

5. The rotatable spout dispensing tube as defined in claim 4 wherein said closure cap is formed from a thermoplastic material selected from the group consisting essentially of polyethylene, polypropylene and copolymers thereof.

6. The rotatable spout dispensing tube as defined in claim 1 wherein indicia is provided on said closure cap which is alignable with indicia on said tubular member to indicate that said tube is in dispensing position.

* * * * *